US005172545A

United States Patent [19]

Forestier

[11] Patent Number: 5,172,545

[45] Date of Patent: Dec. 22, 1992

[54] APPARATUS FOR ATTACHING A PRE-ATOMIZATION BOWL TO A GAS TURBINE ENGINE COMBUSTION CHAMBER

[75] Inventor: Alexandre Forestier, Boissise la Bertrand, France

[73] Assignee: Societe Nationale d'Etude et de Construction de Moteurs d'Aviation (S.N.E.C.M.A.), Paris, France

[21] Appl. No.: 710,112

[22] Filed: Jun. 4, 1991

[30] Foreign Application Priority Data

Jun. 5, 1990 [FR] France ..... 90 06947

[51] Int. Cl.[5] ..... F02C 7/20; F23R 3/46

[52] U.S. Cl. ..... 60/39.32; 60/740; 60/39.31; 431/154; 29/8

[58] Field of Search ..... 60/39.31, 39.32, 734, 60/737, 740, 748, 39.36; 431/154; 29/423, 888.01, 890.02, 464; 269/8

[56] References Cited

U.S. PATENT DOCUMENTS 3,273,343 9/1966 Cretella ..... 60/748
4,722,668 2/1988 Novacek ..... 416/190
4,999,996 3/1991 Duchene et al. ..... 60/39.32

FOREIGN PATENT DOCUMENTS 2073398 10/1981 United Kingdom .

*Primary Examiner*—Richard A. Bertsch
*Assistant Examiner*—L. Jalali
*Attorney, Agent, or Firm*—Bacon & Thomas

[57] ABSTRACT

An apparatus is disclosed for temporarily attaching a pre-atomization bowl to a wall of a generally annular combustion chamber during assembly of the combustion chamber with the fuel injector assembly. The attachment apparatus holds each of the pre-atomization bowls in a position so as to minimize the stress imparted to the fuel injectors during assembly of the engine components. The apparatus utilizes a magnetic attachment device to hold the pre-atomization bowls in their assembly positions. The force of the magnetic attachment device is sufficient to hold the pre-atomization bowls in these positions against the effect of gravity, but is insufficient to prevent the radial movement of the pre-atomization bowls relative to the combustion chamber once the turbojet engine has been assembled. Thus, the device does not inhibit the radial play of the pre-atomization bowls once the engine has been asssembled.

7 Claims, 2 Drawing Sheets

APPARATUS FOR ATTACHING A PRE-ATOMIZATION BOWL TO A GAS TURBINE ENGINE COMBUSTION CHAMBER

BACKGROUND OF THE INVENTION

The present invention relates to an apparatus for facilitating the assembly of gas turbine engine combustion chambers, more particularly such an apparatus which temporarily attaches a pre-atomization bowl to a wall of the combustion chamber during assembly of the gas turbine engine components.

Most present day gas turbine engines, and particularly aircraft turbojet engines, utilize annular combustion chambers which extend around the longitudinal axis of the engine and have fuel pre-atomization bowls located between each of the fuel injector nozzles and the combustion chamber structure. The fuel injector nozzles, each with a pre-atomization bowl, are circumferentially distributed about the upstream portion of the annular combustion chamber so as to provide an even distribution of fuel/air mixture in the combustion chamber. A typical pre-atomization bowl structure is illustrated in U.K. Patent application 2,073,398 A.

The known pre-atomization bowl structures are movable with respect to their attachments to the combustion chamber in order to accommodate the different relative thermal expansion of these elements during operation of the gas turbine engine. The inner and outer walls defining the annular combustion chamber will typically expand or contact a greater amount than will the pre-atomization bowls and the fuel injector nozzles. Thus, some means must be provided to accommodate for this relatively different thermal expansion or contraction between the attachment of the pre-atomization bowl and the wall of the combustion chamber. Accordingly, the pre-atomization bowls are usually mounted so as to be radially floating relative to the combustion chamber as well as axially floating relative to the fuel injector nozzles.

Present day turbojet engines are designed and assembled in modular fashion and the assembly sequence of the combustion chambers usually consists of assembling the combustion chamber equipped with its pre-atomization bowls, inside a chamber casing in which is mounted the fuel injector nozzles. The assembly takes place usually while the engine is in a generally horizontal orientation. In this position, the radial mobility of the pre-atomization bowls relative to the combustion chamber structure allows gravity to place the pre-atomization bowls in an eccentric position relative to the fuel injector nozzles such that their longitudinal axes may be several millimeters lower than corresponding longitudinal axes of the fuel injector nozzles. As a result, there is a danger of subjecting the fuel injector nozzles to excessive stresses during the assembly of the turbojet engine.

SUMMARY OF THE INVENTION

An apparatus is disclosed for temporarily attaching a pre-atomization bowl to a wall of a generally annular combustion chamber during assembly of the combustion chamber with the fuel injector assembly. The attachment apparatus holds each of the pre-atomization bowls in a position so as to minimize the stress imparted to the fuel injector nozzles during assembly of the engine components.

The apparatus utilizes a magnetic attachment device to hold the pre-atomization bowls in their assembly positions. The force of the magnetic attachment device is sufficient to hold the pre-atomization bowls in these positions against the effect of gravity, but is insufficient to prevent the radial movement of the pre-atomization bowls relative to the combustion chamber once the turboject engine has been assembled. Thus, the device does not inhibit the radial play of the pre-atomization bowls once the engine has been assembled.

The magnetic elements are attached to a support member fixedly attached to the wall of the combustion chamber and extending generally in an upstream direction, as well as to a corresponding support member fixedly attached to the pre-atomization bowl and also extending in a generally upstream direction. A tab extending generally radially from a flange of the support member attached to the pre-atomization bowl extends through an opening defined by a flange of the support member attached to the combustion chamber so as to limit relative movement between the pre-atomization bowl and the combustion chamber to a radial direction along a generally radially extending axis.

Prior to assembly of the combustion chamber structure to the fuel injection nozzle structure, the magnetic elements are in contact with each other so as to hold the pre-atomization bowls in their assembly positions. Once assembled, relative movement between the combustion chamber and the pre-atomization bowls, which have now been attached to the fuel injector nozzles, separates the magnetic elements so as to allow free radial movement between the pre-atomization bowl and the combustion chamber.

The flange of the support member attached to the pre-atomization bowl extends generally parallel to the flange of the support member attached to the combustion chamber. The magnetic elements are located adjacent to each other and may be located adjacent to the tab. The magnetic elements may be located on the radially outermost portion of the axis along which the pre-atomization bowl may move, which extends generally radially from the central, longitudinal axis of the engine. One or both of the magnetic elements may be a permanent magnet and, if only one is a permanent magnet then the opposite element is of a magnetic material.

DETAILED DESCRIPTION OF THE PREFERRED EMBODIMENT

Figure 1:
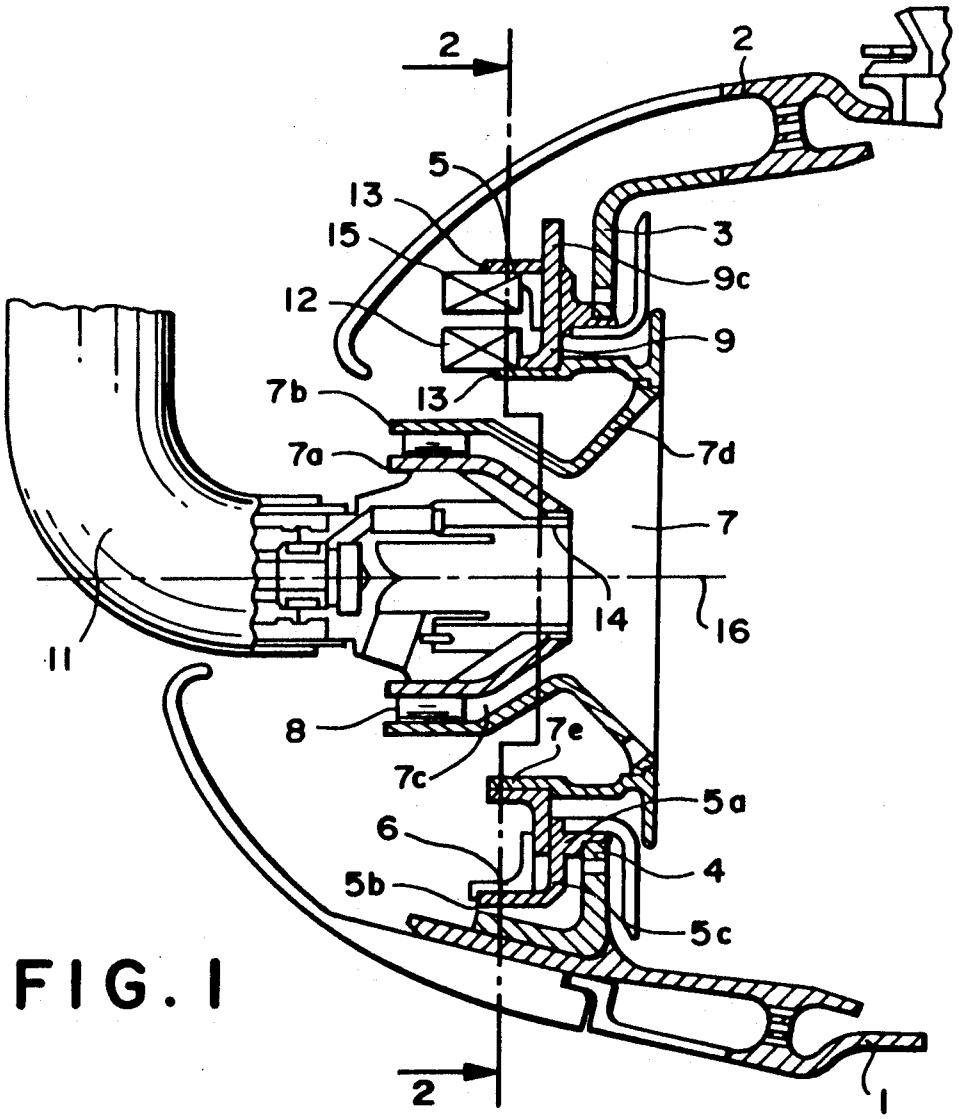
FIG. 1 is a partial, longitudinal, cross-sectional, view of a combustion chamber and a pre-atomization bowl incorporating the present invention after these elements have been assembled.

FIG. 1 is a partial, cross-sectional view illustrating an annular combustion chamber defined by inner and outer walls 1 and 2 assembled to a fuel injection nozzle 11. An upstream wall 3 of the combustion chamber defines a circular opening 4 to accommodate the fuel injector 11 and the pre-atomization bowl 7. In known fashion, fuel is injected through the injector 11, mixed with air in the pre-atomization bowl 7 from which it enters the interior of the combustion chamber in which the fuel/air mixture is ignited. Although only one fuel injector and pre-atomization bowl are illustrated, it is to be understood that a plurality of fuel injectors, each with a pre-atomization bowl are located in a circumferential array disposed about the central longitudinal axis of the combustion chamber.

A first support member 5 is attached to the upstream wall 3 of the combustion chamber and comprises a downstream cylindrical portion 5*a*, which may be welded to the wall 3 around the periphery of the opening 4, and an upstream cylindrical flange portion 5*b*. A central portion 5*c*, extending generally radially to the longitudinal axis of the engine interconnects the upstream and downstream flanges 5*a* and 5*b*. As illustrated in FIG. 1, the diameter of flange portion 5*b* is greater than that of downstream portion 5*a*.

A pre-atomization bowl 7 comprises an inner collar 7*a* and an outer collar 7*b* which are interconnected by a plurality of fins 8. In known fashion, the fins 8 form a swirler to impart a swirling motion to the pre-atomization air passing between the inner and outer collars 7*a* and 7*b*, respectively. The two collars 7*a* and 7*b* define a frusto-conical passage downstream of the fins 8. Outer collar 7*b* further defines a collar portion 7*d* which flares outwardly in frusto-conical configuration.

A generally annular flange member 7*e* is fixedly attached to a downstream edge of collar portion 7*d* and extends in an upstream direction therefrom. The upstream portion of flange 7*e* extends generally parallel to, and is radially inwardly displaced from the flange portion 5*b*.

An assembly collar 9 having a generally "L"-shaped cross section, is fixedly attached, such as by welding, to an external surface of the flange member 7*e*. The assembly collar 9 comprises a generally cylindrical portion 9*a*, which bears against the exterior surface of the flange member 7*e*, and a radial portion 9*b*.

Figure 2:
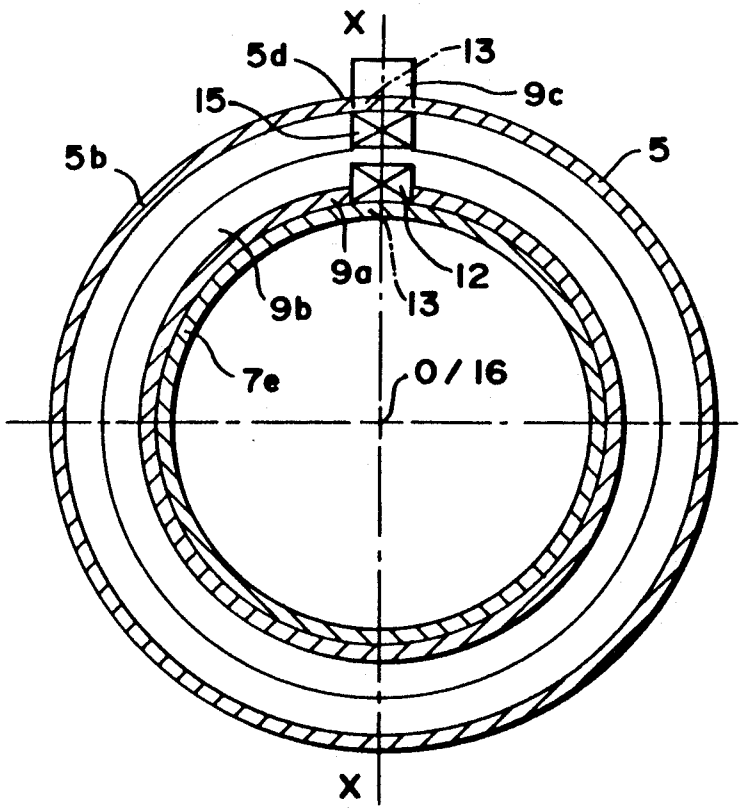
FIG. 2 is a transverse, cross-sectional view taken along line A—A in FIG. 1.

As evidenced in FIGS. 1 and 2, a tab member 9*c* extends radially from the radial portion 9*b* of the collar 9. Tab 9*c* passes through a notch or opening 5*d* defined by the flange 5*b* such that pre-atomization bowl 7 may move radially along axis X—X′ relative to the combustion chamber structure, but may not move axially or rotate about axis O with respect to the combustion chamber. Axial movement of the pre-atomization bowl 7 with respect to the combustion chamber along axis O is prevented by attaching a stop ring 6 to the inside surface of the flange portion 5*b* after the pre-atomization bowl 7, with its assembly collar 9, has been assembled to the combustion chamber.

The combustion chamber structure, including the pre-atomization bowls located on the front wall 3 of the combustion chamber is then ready for assembly with the engine structure having the fuel injection nozzles 11. In order to facilitate this assembly, magnetic attachment means are provided between the flange portions 5*b* and 7*e* to hold each of the pre-atomization bowls in a radially outer position. A first magnetic member 15, which may be a permanent magnet, is affixed to the cylindrical flange portion 5*b* on the diametrical axis X—X′. Member 15 may be located on the innermost surface of the cylindrical flange 5*b*. A second magnetic element 12 is affixed to an outer surface of the flange member 7*e* such that it is also located on axis X—X′ adjacent to the first magnetic member 15. Magnetic members 12 and 15 may be mounted to their respective components by welding, as at 13.

The material used for the permanent magnet may be an anisotropic allow, such as TICONAL M, manufactured by Giffrey Pretre Company, in which its magnetic characteristics are compatible with the operating temperature environment of the turbojet engine. A temperature of 650° C. is below the Curie point (860° C.) of this alloy, but is above the temperature of structural change (550° C.) such that the magnetization loss is slight (approximately 2%). The material of the magnetic element 12 may be Z12 C13 (AFNOR).

Figure 4:
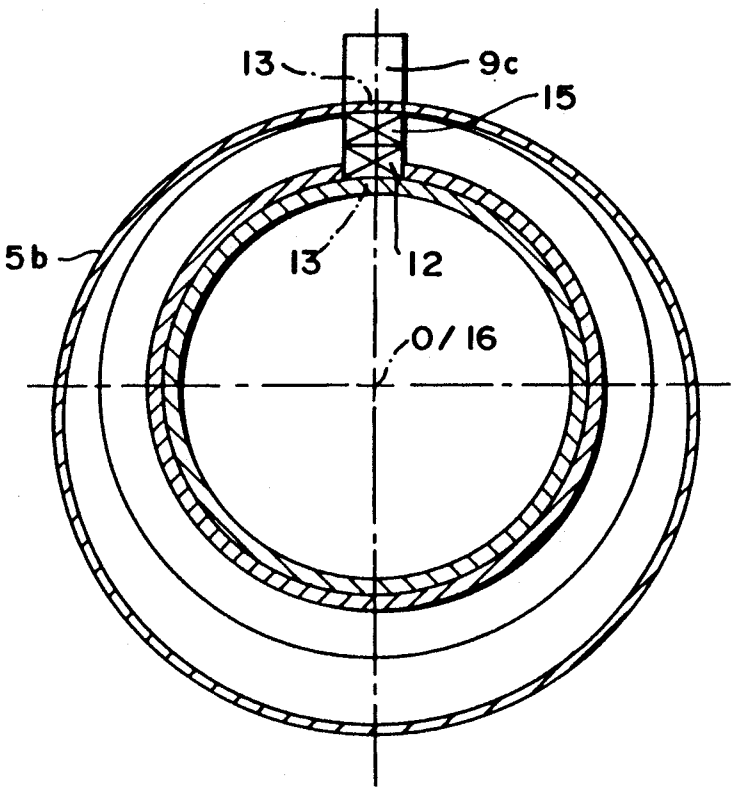
FIG. 4 is a transverse, cross-sectional view taken along line B—B in FIG. 3.
Figure 3:
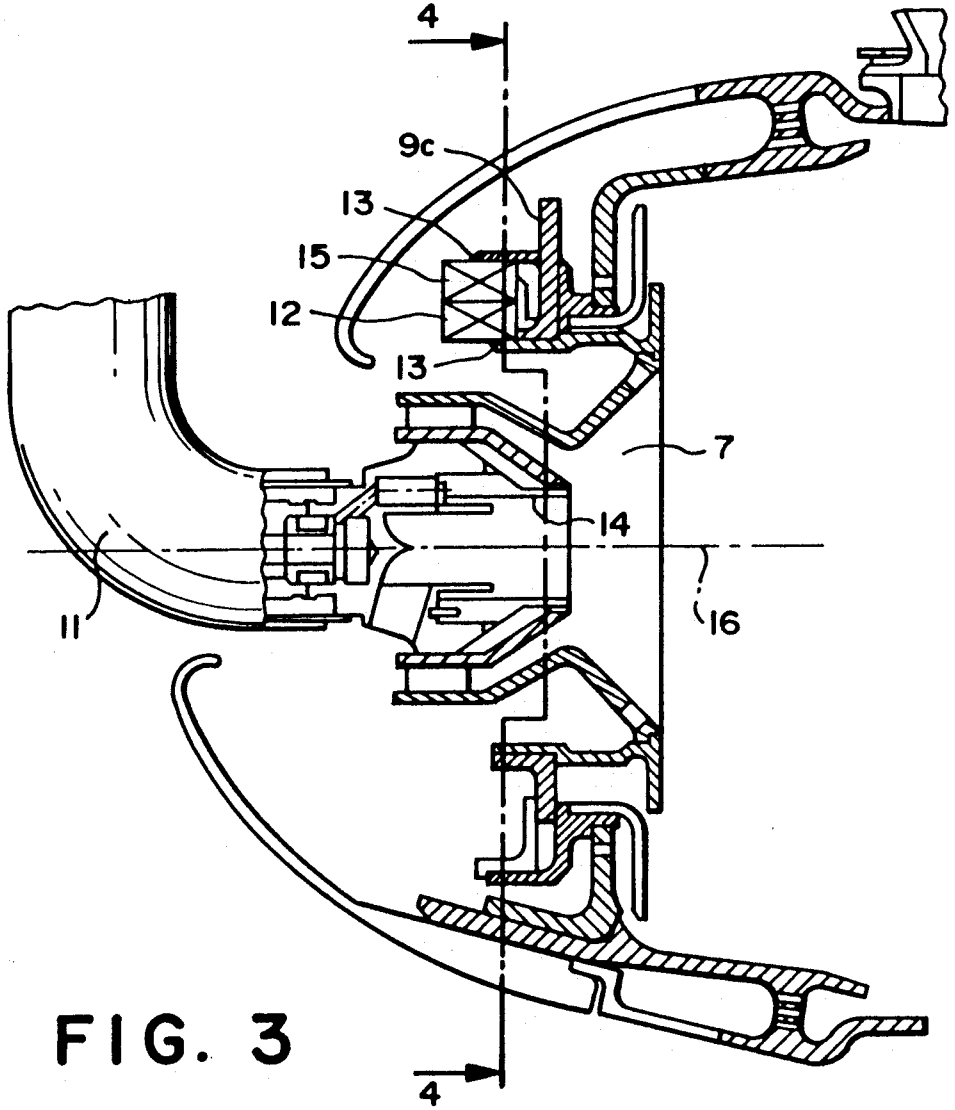
FIG. 3 is a partial, longitudinal, cross-sectional view of the combustion chamber and pre-atomization bowl during assembly with a fuel injector nozzle.

Prior to assembly of the combustion chamber structure with that of the fuel injection nozzles 11, the magnetic elements 12 and 15 are brought into contact with each other such that the pre-atomization bowls 7 are held in the positions shown in FIGS. 3 and 4. Thus, during assembly of these components, the pre-atomization bowls are supported by the magnetic elements 12 and 15, and are not directly supported on the fuel injection nozzle structures, thereby preventing the nozzles from undergoing excessive stresses.

After assembly, and during subsequent combustion chamber operation, the pre-atomization bowls are centered relative to axis 16 of the injector nozzle exit 14, since the force exerted thereon by the pre-atomization bowl by the magnetic elements 12 and 15 is insufficient to overcome the forces exerted on the combustion chamber during engine operation. Once the magnetic elements are separated, the pre-atomization bowl 7 as well as the fuel injector 11 may have free radial play relative to the combustion chamber. Also, the fuel injector 11 may move axially along axis 16 with respect to the pre-atomization bowl 7, since the bowl is prevented from such movement by its attachment to the combustion chamber.

During disassembly of these elements, the magnetic members 12 and 15 are brought into contact so as to relieve the fuel injector 11 from support of the pre-atomization bowls 7. The combustion chamber may be easily disassembled from the structure containing the fuel injectors 11.

The foregoing description is provided for illustrative purposes only and should not be construed as in any way limiting this invention, the scope of which is defined solely by the appended claims.

I claim:

1. Attachment apparatus for temporarily attaching a pre-atomization bowl to a wall of a generally annular combustion chamber having a central longitudinal axis comprising:

a) a first support member attached to the wall of the combustion chamber;

b) a second support member attached to the pre-atomization bowl and extending generally parallel to the first support member;

c) means operatively associated with the first and second support members to limit their relative movement to translational movement along an axis X—X′; and, d) magnetic means having a first portion attached to the first support member and second portion attached to the second support member and located on the X—X′ axis such that the first and second portions are magnetically attached to each other so as to temporarily attach the pre-atomization bowl to the combustion chamber wall.

2. The attachment device of claim 1 wherein axis X—X′ extends generally radially from a central, longitudinal axis of the combustion chamber.

3. The attachment device of claim 1 wherein at least one of the first and second portions of the magnetic means comprises a permanent magnet.

4. The attachment device of claim 1 wherein the first support member defines a first flange portion extending in a generally upstream direction and the second support member defines a second flange portion extending in a generally upstream direction generally parallel to the first flange portion.

5. The attachment device of claim 4 wherein the first portion of the magnetic means is attached to the first flange portion and the second portion of the magnetic means is attached to the second flange portion.

6. The attachment device of claim 5 wherein at least one of the first and second portions of the magnetic means comprises a permanent magnet.

7. The attachment device of claim 6 wherein axis X—X' extends generally radially from a central, longitudinal axis of the combustion chamber.

* * * * *